US007923948B2

(12) United States Patent
Rodas et al.

(10) Patent No.: US 7,923,948 B2
(45) Date of Patent: Apr. 12, 2011

(54) METHOD FOR ADJUSTING THE RESIDUAL LIGHT GAP BETWEEN SLATS OF A MOTORIZED VENETIAN BLIND

(75) Inventors: Herbert Rodas, Encinitas, CA (US); Vyacheslav Baran, Poway, CA (US)

(73) Assignee: Somfy SAS (FR)

( * ) Notice: Subject to any disclaimer, the term of this patent is extended or adjusted under 35 U.S.C. 154(b) by 484 days.

(21) Appl. No.: 11/971,439

(22) Filed: Jan. 9, 2008

(65) Prior Publication Data

US 2009/0173456 A1 Jul. 9, 2009

(51) Int. Cl.
*E06B 9/26* (2006.01)

(52) U.S. Cl. ..... 318/266; 318/286

(58) Field of Classification Search ..... 318/264–266, 318/272, 275, 282, 286, 466–468, 480, 484
See application file for complete search history.

(56) References Cited

U.S. PATENT DOCUMENTS

| | | | | |
|---|---|---|---|---|
| 4,664,169 | A * | 5/1987 | Osaka et al. | 160/107 |
| 4,979,550 | A * | 12/1990 | Long et al. | 160/5 |
| 5,532,560 | A * | 7/1996 | Element et al. | 318/266 |
| 5,603,371 | A * | 2/1997 | Gregg | 160/176.1 P |
| 5,909,093 | A * | 6/1999 | van Dinteren et al. | 318/16 |
| 5,954,108 | A * | 9/1999 | Oda et al. | 160/168.1 P |
| 6,049,293 | A * | 4/2000 | Koot et al. | 340/825.69 |
| 6,069,465 | A | 5/2000 | De Boois et al. | |
| 2006/0184853 | A1 | 8/2006 | Devis et al. | |

FOREIGN PATENT DOCUMENTS

| | | |
|---|---|---|
| EP | 0 913 748 A | 5/1999 |
| EP | 1 659 252 A | 5/2006 |

* cited by examiner

*Primary Examiner* — Bentsu Ro
(74) *Attorney, Agent, or Firm* — Procopio Cory Hargreaves & Savitch LLP; Noel C. Gillespie

(57) ABSTRACT

A method for adjusting the residual light gap between slats of a motorized blind when oriented in a set closed position of the blind, where at least one closed position of the slats is set by automatic detection using detecting means, comprising the following steps: adjusting a detection criterion of the detecting means, performing anew automatic detection of the closed position with adjusted detection criterion, recording the new value of the detection criterion.

11 Claims, 3 Drawing Sheets

METHOD FOR ADJUSTING THE RESIDUAL LIGHT GAP BETWEEN SLATS OF A MOTORIZED VENETIAN BLIND

FIELD OF THE INVENTION

The invention concerns the domain of solar protections, in particular blinds with adjustable slats, which can be controlled using an actuator.

A specific type of actuator for blinds with adjustable slats allows the tilting of the slats according to controls given by a user or by a sensor. Other types of actuators also allow the displacement of the whole blind up and down.

The first ones are generally referred to as tilt-only actuators, while the second ones are named single command actuators.

A tilt-only actuator controls the rotation of an axis, on which is mounted a tipping device. The blind slats are mounted parallel to each other and retained in at least two places along the slat by two control cords, which are themselves attached on one end to the tipping device. One control cord is attached at the front side of the slat, whereas the other cord is attached at the back of the slat. When the axis rotates, the tipping device draws one control cord in one or the other direction and releases the other, so that the slats to which the control cords are attached are tilted.

The control cords can also form a sort of ladder, with the slats resting on the ladder rungs, instead of being attached to the slats. The two control cords may be connected to each other so as to form a loop at the tipping device.

A control unit linked to (or integrated in) the actuator comprises counting means, control means to translate a user command into a corresponding movement of the blind and possibly a receiver for receiving wireless user commands.

The control unit controls the angular orientation of the slats. As such, a user command can be directly interpreted in a given position or angular orientation of the blind slats. The counting means are thus used to define this given position. The counting means are also used to mark out the end limit positions (complete closing of the slats, both positions being approximately at 180° of each other).

The counting means can be of different type: encoder, time pulses, monitoring of a motor parameter such as current. They can also reflect an angle of the slats.

After a first installation of the blind, the latter has to be set, either manually or automatically.

PRIOR ART

Manual settings consists generally in orienting the slats in a first position such as a first end limit position and record this current position as the end limit. This operation can be repeated for a second end limit position and for a preferred intermediate position, such as the position of complete opening, where the slats are approximately parallel to a given direction, in particular the horizontal direction.

An automatic settings routine to calibrate or set the end positions is described in EP 0 913 748. The blind slats are automatically tilted back and forth a number of times between end positions, in order to measure the maximum tilt angle of the slats. Thereafter, the blinds are placed in a reference position, for instance completely opened position at a slat angle of 0°. A manual correction can consequently be performed, using a specific algorithm or a potentiometer, in order to adjust the reference position of one blind with respect to a set of blinds, so the different blinds in the set can be operated harmoniously.

In order to perform automatic settings, the end positions have to be physical end positions or equivalent. In such positions, detecting means are then activated to stop the movement and the corresponding positions as given by the counting means are set as reference end limit positions.

In user mode, EP 0 913 748 relies on position control as given by pulse count of the motor or time pulses, however, an over-current protection is provided to shut down the motor in case a physical end position is reached before the stored count position is reached.

It is also know from EP 1 659 252 to adjust control parameters within a range, using a remote control and getting a visual feedback, in particular when a maximum or minimum adjustment value of the range has been reached. Although this document is interesting, it does not give any details as to how it can be applied to a blind with adjustable slats nor as how it can be applied to redefine an end limit position.

In the case of a blind with orientable slats, the end positions are often positions where further movement is prevented, without them being equipped with a well-defined stop. The end position thus varies from blind to blind when driven by a similar actuator, where such tilt-only actuators can be mounted with a wide range of blinds, from small dimensions blinds to blinds with medium and big dimensions.

It can thus quite regularly happen that a user is not satisfied by the closed arrangement of the slats. This generally means that the detecting means are activated too soon before a desired closed position of the slats is reached. In this end position, there is thus a residual light gap, which is not satisfying. The set torque is generally small to be adapted to the smaller blinds.

SUMMARY OF THE INVENTION

The invention proposes to solve the above-mentioned problem, by allowing the installer to adjust the residual light gap for a blind with orientable slats. In particular, this adjustment is dedicated to assemblies comprising a blind with orientable slats and a tilt-only actuator.

The method according to the invention allows to adjust the residual light gap between slats of a motorized blind when oriented in a closed position of the blind, where at least one closed position of the slats is set by automatic detection using detecting means. It comprises the steps of adjusting a detection criterion of the detecting means, performing anew automatic detection of the closed position with adjusted detection criterion, and recording this new closed position.

Different embodiments of the method are defined by dependant claims 2 to 7. Any other combination of the features of these claims may be envisaged.

The invention also relates to the actuator of claim 8, to the motorized blind of claim 9 and to the installation of claim 10.

The accompanying figures illustrate, by way of example, an embodiment of the method according to the invention.

DESCRIPTION OF THE PREFERRED EMBODIMENTS

Figure 1:
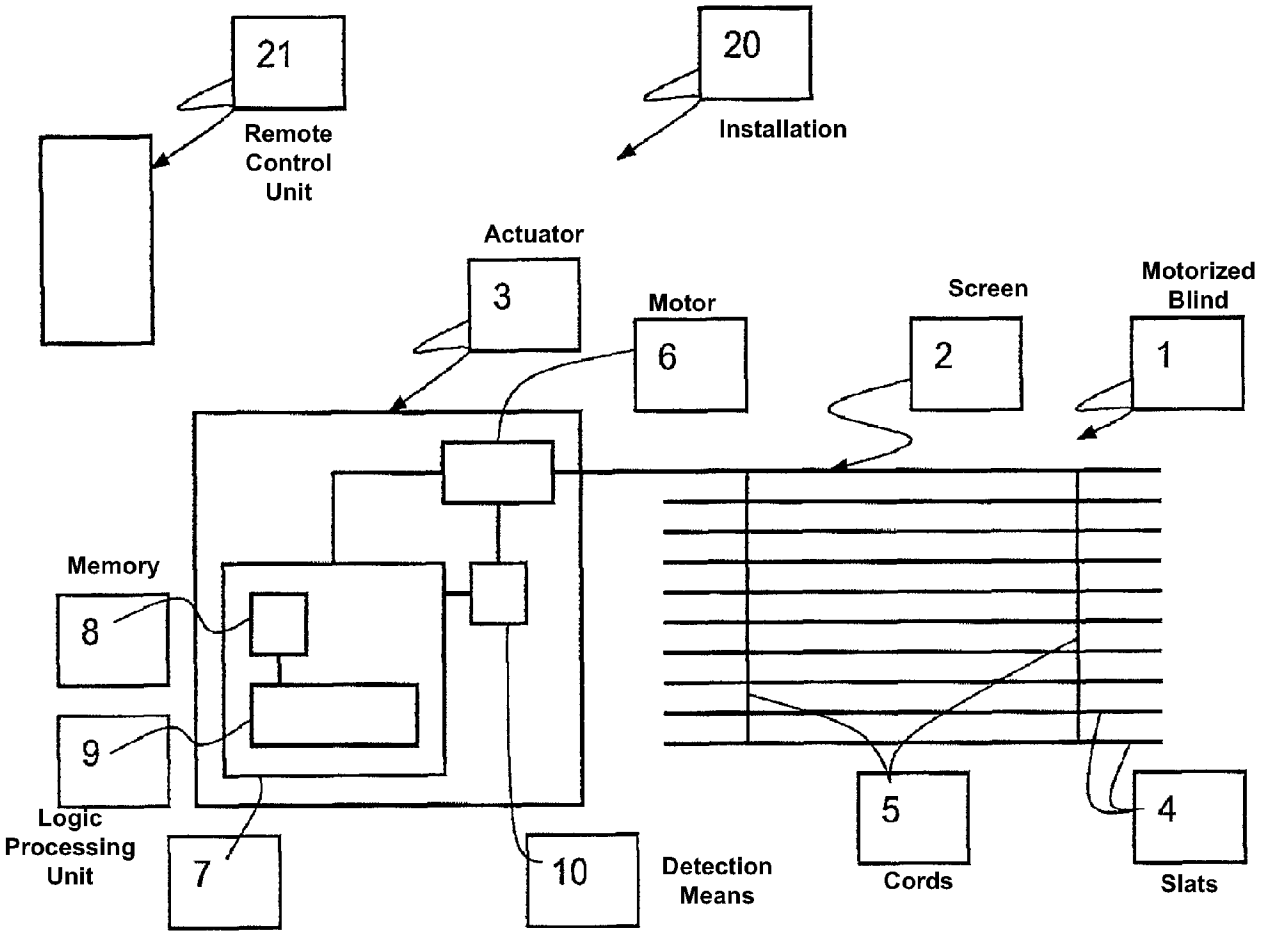
FIG. 1 is a diagram of a motorized venetian blind capable of carrying out the method according to the invention.

The method according to the invention applies to a motorized blind 1 shown in FIG. 1, which mainly comprises a screen 2 having orientable slats 4 retained and controlled with cords 5. An actuator 3 allows to orient the slats between two extreme positions. The represented blind is a venetian blind. However, the invention may be applied to any other type of blind having slats. Particularly, it may also be applied to a blind with vertical slats.

The actuator 3 comprises detection means 10 and a motor 6 controlled by a control unit 7.

The control unit comprises a logic processing unit 9 connected to a memory 8.

The logic processing unit includes among other things software means for controlling the operation of the actuator according to the method to which the invention relates. In particular, these software means comprise computer programs.

Particularly, the actuator comprises a means for determining automatically a closed position of the slats, a means for adjusting a detection criterion used for determining automatically this closed position, a means for recording a value that represents a closed position, and a means for executing logically and/or temporally the steps of the method according to the invention.

Figure 2:
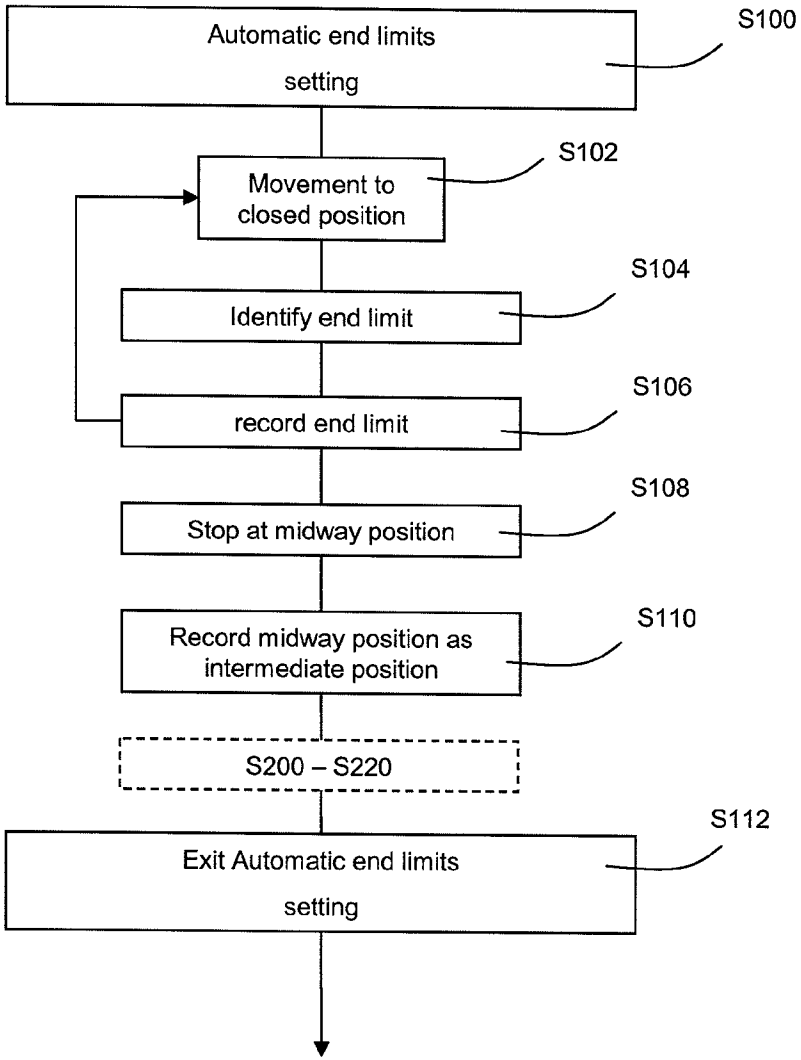
FIG. 2 is a diagram illustrating proceedings for determining automatically the closed positions of the blinds.

FIG. 2 shows a schematic representation of the automatic end limits or closed position settings, for example using a known remote control paired with an actuator comprising a DC motor, driving a venetian-type blind.

A specific control action enables the actuator to enter an automatic end limit setting mode in step S100. This control action can be for example a specific combination of presses on the control buttons of the remote control.

The actuator then starts orienting the slats to reach a closed position of slats in step S102. Step S102 can follow an order for movement given by an installer or user. In Step S104, an end limit is identified: for example as the slats approach the closed position, the motor torque increases and the current draw increases proportionally as well. The motor stops when the current draw exceeds a reference value.

The reached position is recorded as an end limit in step S106 and the process loops back to step S102 in order to repeat the process for the second end limit or second closed position.

When both positions are set, the actuator continues to move the slats in order to place them midway between the end limits in step S110. Step S106 and step S110 require that the actuator comprises a position encoder in the detection means 10, which increases its cost.

These setting steps are similar to the prior art settings as described earlier.

The midway position can be recorded in a step S110 as an intermediate position, which can be directly reached in user mode by a specific button or press on the buttons of the remote control.

In step S112, the automatic end limits setting mode is exited. This step is performed manually or automatically, once the different positions are recorded.

The proceedings between step S110 and step S112 are optional and explained below.

Figure 3:
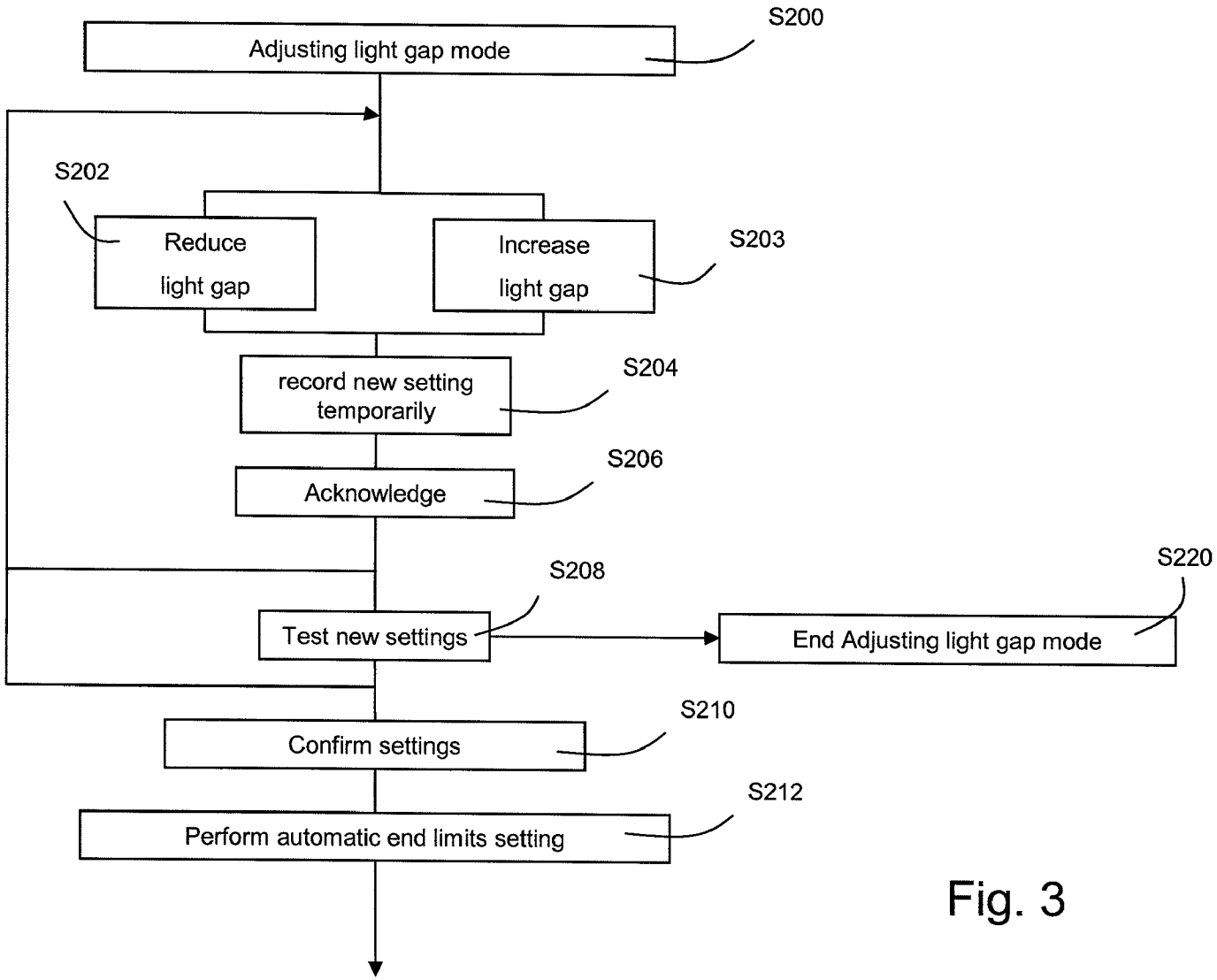
FIG. 3 is a diagram illustrating proceedings for modifying a closed position after this closed position has been determined automatically.

FIG. 3 illustrates more specifically the method for adjusting the residual light gap when the slats are in the closed positions as recorded manually or automatically following the process described above.

A specific control action enables the actuator to enter an adjusting light gap mode in step S200. This control action can be for example a specific combination of presses on the control buttons of the remote control.

Different options are then given to the installer. A first control action enables to reduce the residual light gap in step S202. A second control action enables to increase the light gap in step 203. Once one of these control actions is performed, the light gap setting is recorded temporarily in step S204 and the corresponding record is acknowledged in step S206. The light gap adjustment results in modifying a detection criterion, or several detection criteria, of the detecting means as disclosed hereafter. Recording a light gap setting consists then in recording the new value of the detection criterion.

This process can be repeated at wish at least until a maximum or minimum value is reached. It is interesting that a specific acknowledgement can reflect the fact that this maximum or minimum value has been reached.

The installer or user has then the possibility to test the temporary settings in step S208 by giving commands to move towards one of the end position, using for example a quick press on the control commands of the remote control.

The actuator then starts orienting the slats to reach a closed position of slats until an end limit is identified according to the new settings. This step S208 is not compulsory and can be omitted in the process.

If this new setting is satisfying, it is confirmed in the next step S210, where the new settings are recorded as definite.

If not, it can be readjusted by following the steps S202-S208.

Step S210 is followed, for example automatically, by an automatic process as described relative to FIG. 1, to redefine the end positions in a step S212.

If this setting is not confirmed, the process automatically exits the adjusting light gap mode in step S220 and does not record the new settings.

As an alternative (not shown), each new setting is recorded permanently as long as a new one is not defined. The user may then have the possibility to reset the settings to default settings, for example adapted to blinds of small dimensions.

Such a process can be individually performed for each end position. It is then necessary to indicate during the process, to which end position the new settings should apply. It is thus possible to have different residual light gaps for the two closed positions.

In case the actuator uses a DC motor, the torque is proportional to the current draw. Therefore, the maximum torque allowed can be defined by measuring the current draw of the motor and/or the instantaneous change in current. This change in current is calculated for example by taking current readings on fixed time intervals. These current readings are compared, and if the difference between consecutive readings exceeds the maximum allowed, the motor stops. This position can be recorded as the end limit.

When the actuator is integrated within the blind installation, as the motor approaches the closed position, the torque increases and the current draw increases proportionally as well. The motor stops when the current draw exceeds a reference value.

This reference value for the maximum current draw allowed can be adjusted as described above, hence increasing or decreasing the torque and consequently changing the position of the end limits and the residual light gaps when the slats are in a closed position.

In this case, the detection means 10 includes a means for measuring the current draw.

If an AC motor is used, it is possible to adjust another motor parameter in order to affect the detecting means, for instance the voltage draw across a phase shift capacitor. The same process applies. In this case, the detection means 10 includes a means for measuring this other parameter.

The process applies to tilt-only actuators but can be equally applied to single command actuators. In the case of single command actuators, the closed positions of the slats correspond to the start of an UP or down movement. The tipping device then slides upon the rotation axis driven by the actuator. The change in torque consequent to the beginning of an UP or DOWN movement can equally be detected and the closed positions of the slats can be recorded automatically and adjusted according to the invention method.

According to the instant application, a residual light gap between the slats is a gap between the slats and through which light rays may enter a room.

As a result of the invention, the angular position of the slats may be determined by counting means, which reference values are set when the closed position is recorded. A position encoder included in the detection means can be used to determine an intermediate favorite position between the two closed positions. Alternatively, a time measurement method can be used to determine such position. In that case, the current position is derived from the time of operation of the motor and from its speed profile.

In all cases, the setting of the intermediate position is automatically modified when a light gap adjustment is performed.

The light gap adjustment can be performed at any time by the installer or even by the user, when activating step S200. Then an installation 20 comprising a remote control unit 21 and a motorized blind 1 with orientable slats can enter in a light gap adjustment mode, wherein the closed position of the slats is adjustable by means of the remote control unit.

It is also possible to enter systematically in the light gap adjustment mode during the automatic end limits setting process of the FIG. 1, for instance by inserting steps S200-S220 between steps S110-S112. In that case, no specific control action is requested in step S200, which can be omitted.

The invention claimed is:

1. A method for adjusting the residual light gap between slats of a motorized blind when oriented in a set closed position, where at least one closed position of the slats is set by automatic position detection using detecting means, comprising the following steps:

adjusting a detection criterion of the detecting means in response to a control action by a user, the control action specifying an adjustment to the orientation of slats in the closed position, performing a new automatic detection of the closed position with adjusted detection criterion, recording the new value of the detection criterion; and associating the new value with the at least one closed position.

2. The method as claimed in claim 1, wherein the method further comprises a step of receiving an acknowledgement from a user that the current position of the slats of the blind is acceptable to the user.

3. The method as claimed in claim 1, wherein the detection criterion is a motor parameter.

4. The method of claim 3, wherein the motor parameter is current draw.

5. The method as claimed in claim 1, wherein the step of performing automatic detection of at least one closed position comprises driving the slats into a position where further movement requires an increase in torque, without this position being a frank physical stop.

6. The method as claimed in claim 1, wherein the step of performing automatic detection of at least one closed position comprises controls of torque as well as of instantaneous change in torque.

7. The method as claimed in claim 1, wherein an individual adjustment of the residual light gap is performed for each closed position.

8. The method as claimed in claim 1, wherein recording of the closed position is added to the step of recording the new value of the detection criterion.

9. An actuator comprising hardware and software means for implementing the method as claimed in claim 1.

10. A motorized blind with orientable slats comprising an actuator as claimed in claim 9.

11. An installation comprising a motorized blind with orientable slats and a remote control unit comprising means to enter in a light gap adjustment mode, wherein the closed position of the slats is adjustable by means of the remote control unit, wherein the remote control can adjust the orientation of slats in the closed position of the slats, wherein the motorized blind includes a detecting means configured to set the closed position of the slats by automatic position detection, and wherein the motorized blind includes an actuator configured to perform the following steps when in the gap adjustment mode:

adjusting a detection criterion of the detecting means in response to a control action by a user, the control action specifying an adjustment to the orientation of slats in the closed position, performing a new automatic detection of the closed position with adjusted detection criterion, recording the new value of the detection criterion; and associating the new value with the at least one closed position.

* * * * *